US010662823B2

(12) United States Patent
Hughes et al.

(10) Patent No.: US 10,662,823 B2
(45) Date of Patent: May 26, 2020

(54) SYSTEM AND METHOD FOR RECOVERING WASTE HEAT

(71) Applicants: Modine Manufacturing Company, Racine, WI (US); Cummins Inc.

(72) Inventors: Gregory Gerald Hughes, Milwaukee, WI (US); Michael J. Reinke, Franklin, WI (US); Tony Rousseau, Racine, WI (US); Timothy C. Ernst, Columbus, IN (US); James Zigan, Versailles, IN (US); Christopher Nelson, Columbus, IN (US)

(73) Assignees: MODINE MANUFACTURING COMPANY, Racine, WI (US); CUMMINS INC., Columbus, IN (US)

( * ) Notice: Subject to any disclaimer, the term of this patent is extended or adjusted under 35 U.S.C. 154(b) by 826 days.

(21) Appl. No.: 14/430,796

(22) PCT Filed: Sep. 24, 2013

(86) PCT No.: PCT/US2013/061395

§ 371 (c)(1),
(2) Date: Mar. 24, 2015

(87) PCT Pub. No.: WO2014/052310

PCT Pub. Date: Apr. 3, 2014

(65) Prior Publication Data

US 2015/0275701 A1 Oct. 1, 2015

Related U.S. Application Data

(60) Provisional application No. 61/705,168, filed on Sep. 25, 2012.

(51) Int. Cl.
*B21D 53/08* (2006.01)
*F01K 23/00* (2006.01)
(Continued)

(52) U.S. Cl.
CPC ..... *F01K 23/10* (2013.01); *F01K 7/16* (2013.01); *F28D 7/0025* (2013.01); *F28D 9/00* (2013.01);
(Continued)

(58) Field of Classification Search
CPC ..... F28D 7/0025; F28D 1/05308; F28D 1/00; F28D 7/0008; F01K 23/00; B21D 63/08
(Continued)

(56) References Cited

U.S. PATENT DOCUMENTS 2,617,634 A * 11/1952 Jendrassik ..... F28D 9/0043 165/140
3,830,290 A 8/1974 Thamasett et al.
(Continued)

FOREIGN PATENT DOCUMENTS

| | | |
|---|---|---|
| DE | 4403144 | 3/1995 |
| EP | 0981035 | 2/2000 |
| JP | 2011132570 | 7/2011 |
| WO | WO2012045845 | 4/2012 |

OTHER PUBLICATIONS

International Search Report and Written Opinion for Application No. PCT/US2013/061394 dated Feb. 18, 2014 (6 pages).
(Continued)

*Primary Examiner* — Deming Wan
(74) *Attorney, Agent, or Firm* — Michael Best & Friedrich LLP; Michael Bergnach; Jeroen Valensa

(57) ABSTRACT

A power generation system having a combustion engine with a Rankine bottoming cycle, the system including a first flow path for a process fluid and a second flow path for a working fluid, and a heat exchanger arranged along both the first and the second flow paths to transfer waste heat from the process fluid to the working fluid. The heat exchanger includes a first flow conduit being bounded by a first wall section and configured to convey the process fluid, a second
(Continued)

flow conduit to convey the working fluid, the second flow conduit being bounded by a second wall section spaced apart from the first wall section to define a gap therebetween, and a thermally conductive structure arranged within the gap and joined to the first and second wall sections to transfer heat therebetween, the gap being fluidly isolated from both the process fluid and the working fluid.

9 Claims, 8 Drawing Sheets

(51) Int. Cl.

| | |
|---|---|
| ***F28D 15/00*** | (2006.01) |
| ***F28F 1/00*** | (2006.01) |
| ***F28D 7/00*** | (2006.01) |
| ***F01K 23/10*** | (2006.01) |
| ***F28D 21/00*** | (2006.01) |
| ***F28F 9/00*** | (2006.01) |
| ***F28F 3/02*** | (2006.01) |
| ***F01K 7/16*** | (2006.01) |
| ***F28D 9/00*** | (2006.01) |
| ***F28F 3/00*** | (2006.01) |
| ***F28F 9/02*** | (2006.01) |

(52) U.S. Cl.
CPC ..... *F28D 15/00* (2013.01); *F28D 21/0003* (2013.01); *F28F 3/005* (2013.01); *F28F 3/02* (2013.01); *F28F 3/027* (2013.01); *F28F 9/001* (2013.01); *F28F 9/0246* (2013.01); *F28F 2265/26* (2013.01)

(58) Field of Classification Search
USPC ..... 60/618, 616; 123/2–3; 165/172, 173, 165/164, 165
See application file for complete search history.

(56) References Cited

U.S. PATENT DOCUMENTS

| | | | | |
|---|---|---|---|---|
| 3,999,602 | A * | 12/1976 | Fewell | F22B 1/063 165/70 |
| 4,002,201 | A * | 1/1977 | Donaldson | F28D 1/0333 165/140 |
| 4,177,858 | A | 12/1979 | Daman et al. | |
| 4,249,593 | A | 2/1981 | Bieberbach et al. | |
| 4,448,243 | A | 5/1984 | Pain | |
| 5,416,323 | A | 5/1995 | Hoots et al. | |
| 6,250,380 | B1 | 6/2001 | Strahle et al. | |
| 6,817,406 | B1 * | 11/2004 | Inoue | F28D 9/0043 165/115 |
| 7,610,949 | B2 | 11/2009 | Palanchon | |
| 7,896,066 | B2 | 3/2011 | Higashiyama | |
| 8,783,335 | B2 * | 7/2014 | Suzuki | F25B 39/04 165/134.1 |
| 2009/0025916 | A1 | 1/2009 | Meshenky et al. | |
| 2009/0260775 | A1 * | 10/2009 | Maucher | F01N 5/02 165/41 |
| 2010/0126172 | A1 * | 5/2010 | Sami | F01K 25/06 60/651 |
| 2010/0206001 | A1 * | 8/2010 | Takahashi | B60H 1/323 62/498 |
| 2010/0300651 | A1 | 12/2010 | Kumar et al. | |
| 2019/0017755 | A1 * | 1/2019 | Kim | B23K 33/006 |

OTHER PUBLICATIONS

International Search Report and Written Opinion for Application No. PCT/US2013/061395 dated Feb. 21, 2014 (6 pages).
David B. Sarraf, Heat Pipe Heat Exchanger with Two Levels of Isolation for Environmental Control of Manned Spacecraft Crew Compartment, SAE Technical Paper 2006-01-2163, published Jul. 17, 2006 (9 pages).
Office Action from the US Patent and Trademark Office for U.S. Appl. No. 14/430,787 dated Feb. 10, 2017 (17 pages).

* cited by examiner

SYSTEM AND METHOD FOR RECOVERING WASTE HEAT

CROSS-REFERENCE TO RELATED APPLICATIONS

This application claims priority to U.S. Provisional Patent Application No. 61/705,168 filed on Sep. 25, 2012, the entire contents of which are incorporated herein by reference.

STATEMENT REGARDING FEDERALLY SPONSORED RESEARCH OR DEVELOPMENT

This invention was made with government support under DOE Program Award No. EE0003403 "Recovery Act-System Level Demonstration of Highly Efficient and Clean, Diesel Powered Class 8 Trucks (SUPERTRUCK)". The government has certain rights in this invention.

BACKGROUND

The Rankine cycle is a known thermodynamic power generation cycle wherein a working fluid is repeatedly cycled through a closed loop. Typically, heat energy is delivered to the working fluid in a first portion of the cycle, and is partially converted to useful mechanical work in a second portion of the cycle. The working fluid is pressurized as a liquid to a high pressure state, and this high-pressure liquid is then vaporized and superheated by the heat energy. The mechanical work is recovered by non-adiabatically expanding the superheated vapor to a lower pressure state. Such a system is known to be used as a bottoming cycle for the recovery of waste heat from process streams.

The combustion of fuel-air mixtures to produce power is similarly known. Typically, the combustion process converts chemical energy that is present in the fuel, in combination with a supply of oxygen, to mechanical work, leaving some amount of that energy as waste heat. This waste heat can be used as the heat source for a Rankine bottoming cycle in order to increase the overall power conversion efficiency of a power generation system.

SUMMARY

According to an embodiment of the invention, a power generation system having a combustion engine with a Rankine bottoming cycle includes a first flow path for a process fluid of the combustion engine, a second flow path for a working fluid of the Rankine cycle, and a heat exchanger arranged along both the first and the second flow paths to transfer waste heat from the process fluid to the working fluid. The heat exchanger includes at least one first flow conduit to convey the process fluid through the heat exchanger, and at least one second flow conduit to convey the working fluid through the heat exchanger. A first wall section bounding the first flow conduit and a second wall section bounding the second flow conduit are spaced apart to define a gap. A thermally conductive structure is arranged within the gap, and is joined to the first and second wall sections to transfer heat. The gap is fluidly isolated from both the process fluid and the working fluid.

In some embodiments, the process fluid includes recirculated exhaust gas. In other embodiments, the process fluid includes boosted charge air.

In some embodiments, the working fluid of the Rankine cycle includes a combustible fuel. In some embodiments the working fluid of the Rankine cycle includes a hydrofluorocarbon.

In some embodiments, the process fluid is at a first pressure, the working fluid is at a second pressure, and the gap between the wall sections is at a third pressure that is less than both the first and second pressures.

In some embodiments, the heat exchanger includes multiple channels arranged within the gap and defined by the thermally conductive structure and the first and second wall sections. In some such embodiments each channel is bounded by exactly one of the first and second wall sections.

According to another embodiment of the invention, a method of recovering waste heat from a combustion engine includes directing a flow of process fluid containing waste heat along a first flow path towards an intake manifold of the combustion engine, and directing a flow of pressurized working fluid along a second flow path towards an expander. The method further includes the steps of: convectively transferring waste heat from the process fluid to a first wall section arranged along the first flow path; convectively transferring the waste heat to the working fluid from a second wall section arranged along the second flow path; and conductively transferring the waste heat from the first wall section to the second wall section across a gap between the wall sections.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
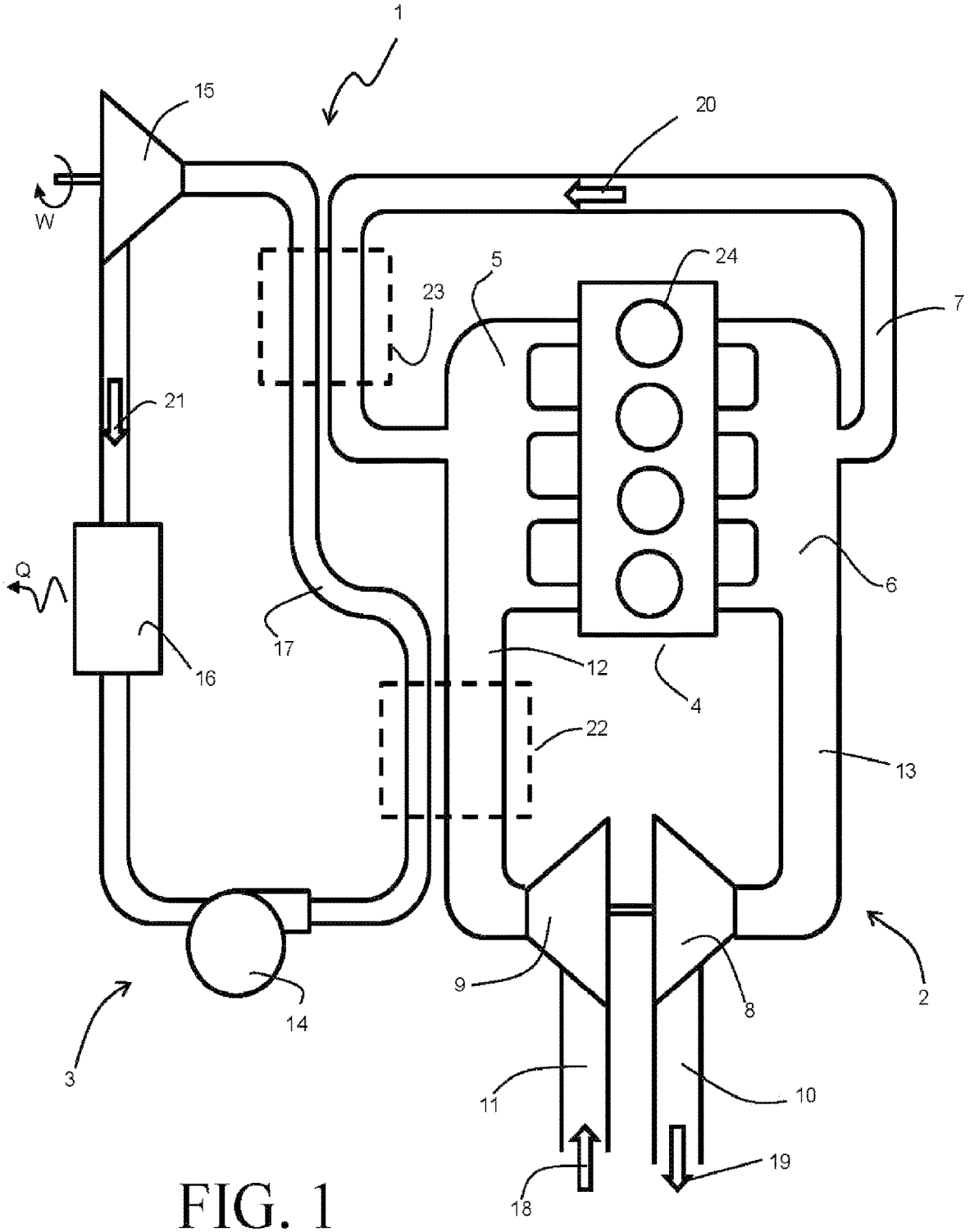
FIG. 1 is a schematic diagram showing certain portions of a power generation system, according to an embodiment of the invention.

A power generation system 1 according to an embodiment of the invention is shown in schematic fashion in FIG. 1, and includes a Rankine bottoming cycle 3 operationally coupled to a combustion system 2. The power generation system 1 can be incorporated within a mobile system or, alternatively, within a stationary power generation system. By way of example only, the power generation system 1 can provide motive power for a tractor-trailer combination, a bus or other form of passenger transport, off-highway work equipment such as excavators and the like, agricultural equipment, automobiles, or other forms of transportation.

In the exemplary embodiment of FIG. 1, the combustion system 2 is depicted as a turbocharged compression-ignition system operating on the Diesel cycle. It should be recognized by one skilled in the art, however, that the power generation system 1 could alternatively use a combustion system operating on other types of cycles including, but not limited to, the Otto cycle, the Stirling cycle, the Atkinson cycle, the Miller cycle, and others. In all cases, the combustion system 2 produces waste heat streams at one or more elevated temperatures. At least some of this waste heat can be recovered by the Rankine bottoming cycle 3 to be converted to useful work.

The combustion system 2 includes an engine 4 having multiple combustion cylinders 24 (four cylinders 24 are shown, the actual number of cylinders can be different). An intake manifold 5 is coupled to the engine 4 to deliver combustion air to the cylinders 24, and an exhaust manifold 6 is coupled to the engine 4 to remove exhaust from the cylinders 24. Fuel delivery to the engine is not shown, but can be accomplished through conventional means such as port injection or direct injection into the cylinders, among others.

The combustion system 2 further includes an exhaust turbine 8 coupled to an air compressor 9. The air compressor 9 serves as a source for combustion air 18, which is boosted to an elevated pressure by expanding a flow of exhaust 19 received from the engine 4. The exhaust 19 is received into the exhaust turbine 8 through an exhaust conduit 13, which fluidly couples an inlet of the exhaust turbine 9 to the exhaust manifold 6. The expanded exhaust 19 is removed from the exhaust turbine 8 by way of an exhaust pipe 10. An exhaust after-treatment system (not shown) can optionally be located downstream of the exhaust turbine 8, or it can be optionally located along the exhaust conduit 13. In some cases an exhaust after-treatment system may not be necessary at all, however.

The boosted (or "turbocharged") air 18 is delivered to the intake manifold 5 through an air conduit 12. The temperature of the air 18 is often substantially elevated by the compression process occurring in the compressor 9, and it can be highly desirable to cool the air (in order to increase the air density, for example) before delivery to the combustion cylinders 24. To that end, it may be desirable to recover the waste heat that is to be removed from the compressed air 19 into the Rankine bottoming cycle 3 through a heat exchanger 22, as will be discussed below.

The exhaust manifold 6 can function as a source for a portion 20 of the exhaust from the combustion cylinders 24, which is recirculated back to the intake manifold 5 through an exhaust gas recirculation conduit 7. Such recirculation of exhaust gas is known to be effective in reducing the amount of a known pollutant (oxides of nitrogen, or NOx) produced during the combustion process. The production of NOx is highly dependent on the temperatures that are present within the combustion cylinders, with elevated temperatures leading to increased NOx formation. The addition of the relatively inert exhaust gas as a diluent serves to increase the thermal mass of the fluids within the cylinders without affecting the oxygen to fuel ratio, thereby reducing the peak temperatures and, consequently, the amount of NOx. Cooling of the recirculated exhaust gas 20 can further reduce the peak temperatures, and can also increase the charge density within the cylinders 24, and is therefore desirable. The recirculated exhaust gas 20 can thus provide a ready source of high-temperature heat to be recovered into the Rankine bottoming cycle 3, such as through a heat exchanger 23 provided along the exhaust gas recirculation conduit 7.

The Rankine bottoming cycle 3 circulates a working fluid 21 along a closed circuit 17. A pump 14 pressurizes the working fluid 21 as a sub-cooled liquid to an elevated pressure, and forces the working fluid 21 along the circuit 17. An expander 15 receives the working fluid 21 as a superheated vapor at the elevated pressure, and expands the working fluid to a lower pressure. Mechanical work (indicated in FIG. 1 by "W") is recovered through the expansion process. Heat energy is received into the flow of working fluid as it passes through the circuit 17 between the pump 14 and the expander 15, and converts the pressurized working fluid from a sub-cooled liquid to a superheated vapor in order to produce the recovered work in the expansion process. The heat energy can be recovered from the combustion system 2 by transferring waste heat from the turbocharged air 18 in the heat exchanger 22 and/or from the recirculated exhaust gas 20 in the heat exchanger 23. In certain embodiments of the system the waste heat is recovered from one of those waste streams but not the other, while in other embodiments waste heat is recovered from both. Furthermore, in some embodiments additional waste heat is recovered from other streams (for example, from the non-recirculated exhaust 19).

Once expanded, the working fluid 21 must be cooled and condensed in order to complete the cycle and to be returned to the inlet of the pump 14 as a sub-cooled liquid. A condenser 16 is located along the circuit 17 between the expander 15 and the pump 14, and the remaining heat (indicated in FIG. 1 as "Q") is removed from the working fluid 21 within the condenser 16.

Various working fluids are available for use in Rankine bottoming cycles, and the selection of a specific working fluid strongly impacts the thermodynamic efficiency of the system. In one embodiment the working fluid can include any working fluid that would result in a hazardous byproduct resulting from the combustion process, such as fluorine, chlorine, or bromine. The thermodynamic efficiency of the system can be quantified as the ratio between the recovered work (W) and the total heat input to the system (the sum of Q and W). Two classes of working fluids that are of particular interest are HFC refrigerants such as R245fa and the like, and hydrocarbons such as ethanol, methanol, propane, butane, toluene, naphthalene, and the like. Both of these classes of fluids pose challenges when used in the power generation system 1 due to the potential for leakage of the working fluid into the combustion system 2.

Both of the heat exchangers 22 and 23 transfer waste heat from a process fluid stream that is afterwards directed into the combustion cylinders 24. Due to the elevated pressure of the working fluid 21 between the compressor 14 and the expander 15, any breach of the physical separation between the working fluid 21 and the process fluid (20 or 18) can result in the working fluid leaking into the process fluid stream. Such a leakage is highly undesirable in that it would result in the working fluid reaching the combustion cylinders 24. In the case of a HFC working fluid (which contains fluorinated hydrocarbons), the high temperatures within the combustion cylinder can result in the formation of hydrogen fluoride, which would be released as part of the exhaust 19 and is undesirable. In the case of a hydrocarbon working fluid, the leaking working fluid would act as a combustible fuel and could result in an uncontrolled fueling of the combustion system 2, which could lead to an engine runaway condition.

In order to prevent the foregoing, the heat exchangers 22 and 23 are designed to provide isolation between the working fluid 21 and the process fluid 18 or 20 so that, in the case of a breach within the heat exchanger, leakage of the working fluid into the process fluid stream is avoided.

Figure 2:
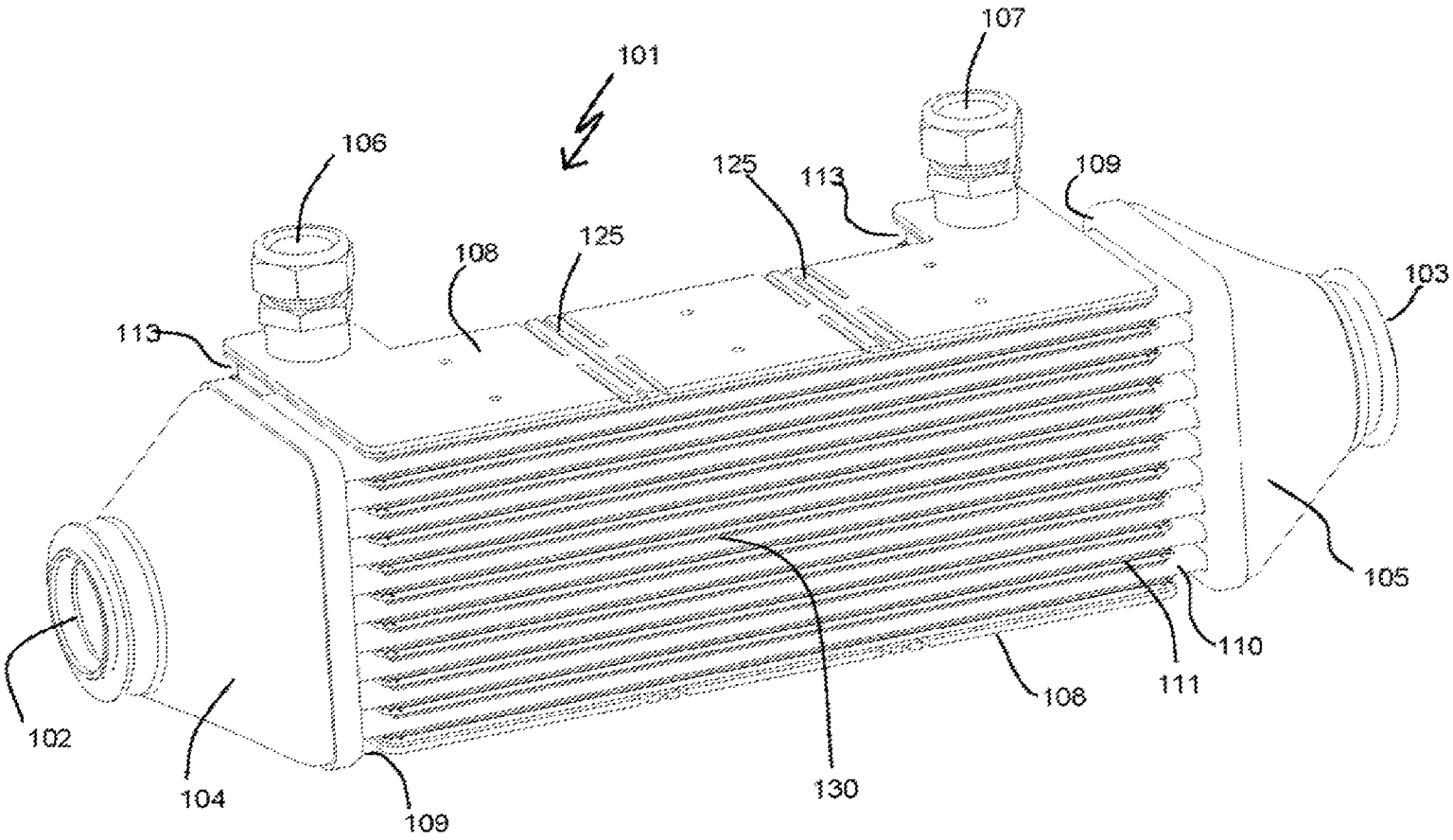
FIG. 2 is a perspective view of a heat exchanger for use in the power generation system of FIG. 1.

A heat exchanger 101 suitable for use as either of the heat exchangers 22 and 23 is shown in FIG. 2, and includes a first flow path for a process fluid (such as the air 18 or the recirculated exhaust 20) extending between an inlet port 102 and an outlet port 103. An inlet manifold 104 is coupled to the inlet port 102 to receive a flow of the process fluid therefrom. An outlet manifold 105 is coupled to the outlet port 103 to deliver a flow of the process fluid thereto. A plurality of tubes 110 extend between the inlet manifold 104 and the outlet manifold 105, and serve as flow conduits to transport the process fluid from the inlet manifold 104 to the outlet manifold 105. While the exemplary embodiment includes ten of the tubes 110, it should be understood that other embodiments of the invention can include more or fewer tubes 110, as may be desirable for the particular application.

The tubes 110 extend into the manifolds 104, 105 through headers 109 arranged at opposing ends of the heat exchanger 101. The headers 109 each define a boundary wall of one of the manifolds 104, 105. In some embodiments the header 109 can be formed integrally with a manifold 104 or 105, while in other embodiments the header 109 can be formed as a separate component that is assembled to the remainder of the manifold 104 or 105. As one example, the header 109 can be formed from flat sheet steel and can be brazed or welded to an open end of a casting to define a manifold 104 or 105. As another example, a header 109 can be provided with mechanical mounting features to allow for assembly of the heat exchanger 101 into a system, with the remainder of the manifold 104 or 105 being provided as part of the piping for the process fluid.

Figure 6:
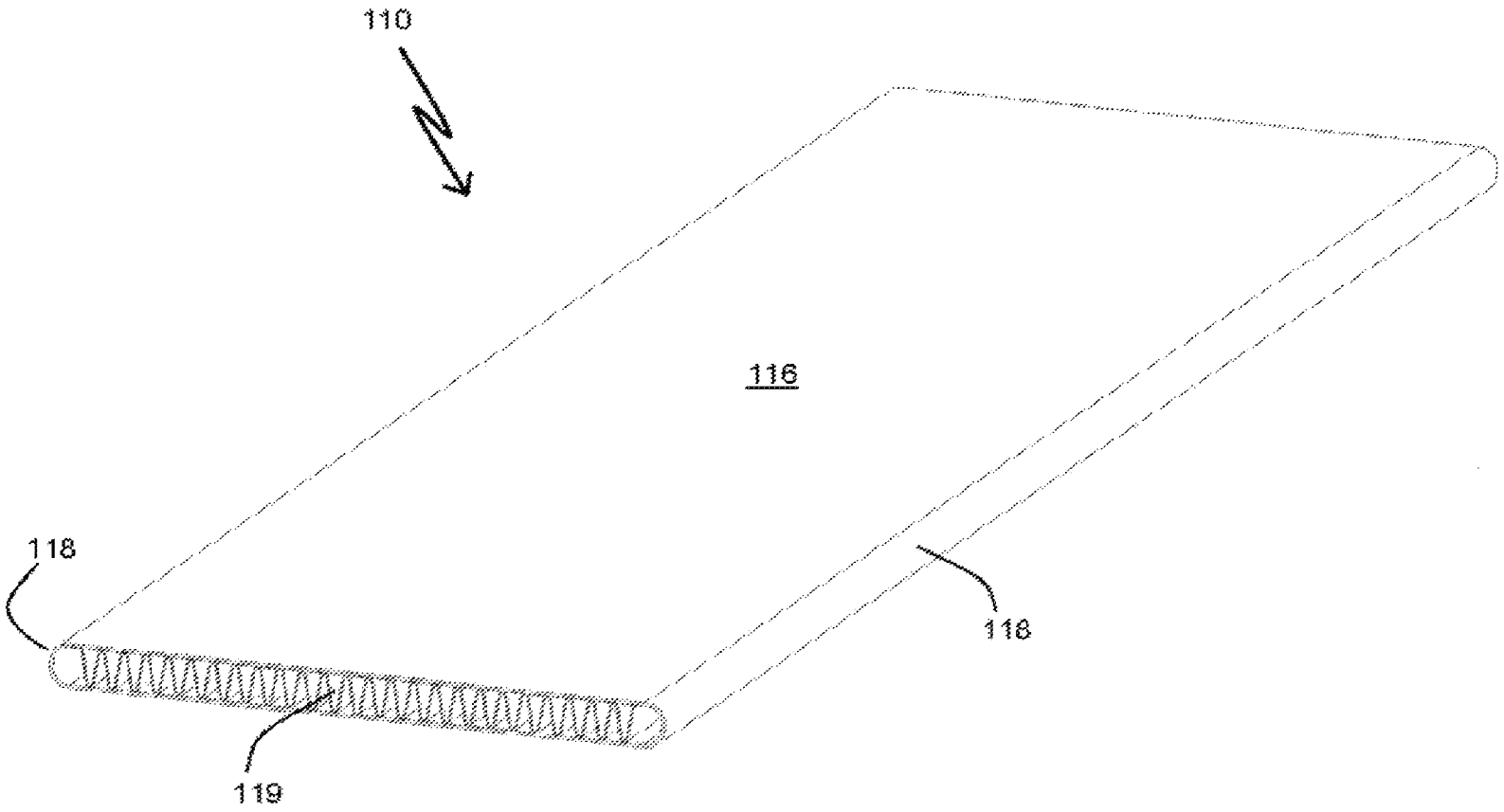
FIG. 6 is a perspective view of a tube and insert for use in the heat exchanger of FIG. 2.

An example of a single tube 110 as used in the exemplary heat exchanger 101 is depicted in FIG. 6. As shown therein, the tube 110 includes a pair of opposing broad and planar walls 116, spaced apart and joined by a pair of short walls 118. The short walls 18 are depicted as arcuate in profile, although in some other embodiments the short walls can have a straight or other non-arcuate profile. The tube 110 can be formed as a single piece from sheet steel or aluminum, such as by seam welding a round tube from sheet material and then flattening the tube to produce the pair of broad and flat walls 116 and the pair of short walls 118. Alternatively, the tube 110 can be formed from more than one piece. An insert 119 is preferably provided internal to the tube 110. The insert 119 can provide one or more benefits, including (but not limited to) increasing the internal surface area for improved heat transfer, turbulating the flow of the process fluid for increased heat transfer, and strengthening the tube walls 116. It should be understood by those skilled in the art that the insert 119, if present, can take on any number of forms known in the art, including square wave, serpentine, sine wave, lanced and offset, etc. In some cases the tube 110 and the insert 119 can be an integral component, such as (for example) an extruded structure.

Interleaved with the tubes 110 are a plurality of plate assemblies 111. The plate assemblies 111 serve as flow conduits to transport a working fluid through the heat exchanger 101. The plate assemblies 111 are in fluid communication with a pair of manifolds 113 for the working fluid. Fluid ports 106 and 107 are connected to the manifolds 113, and allow for the working fluid to be delivered to and received from the heat exchanger 101.

In the exemplary embodiment of FIG. 2, the fluid port 106 is arranged at a common end of the heat exchanger 1 with the process fluid inlet port 102. Similarly, the fluid port 107 is arranged at a common end of the heat exchanger 101 with the process fluid outlet port 103. This arrangement allows for the process and working fluids to be circuited through the heat exchanger 101 in either an overall counter-flow arrangement (by flowing the working fluid into the heat exchanger 101 through the port 107 and removing it through the port 106) or an overall concurrent-flow arrangement (by flowing the working fluid into the heat exchanger 101 through the port 106 and removing it through the port 107). Other arrangements of the fluid ports 106, 107 are also possible, and will be explained in greater detail below.

Figure 7:
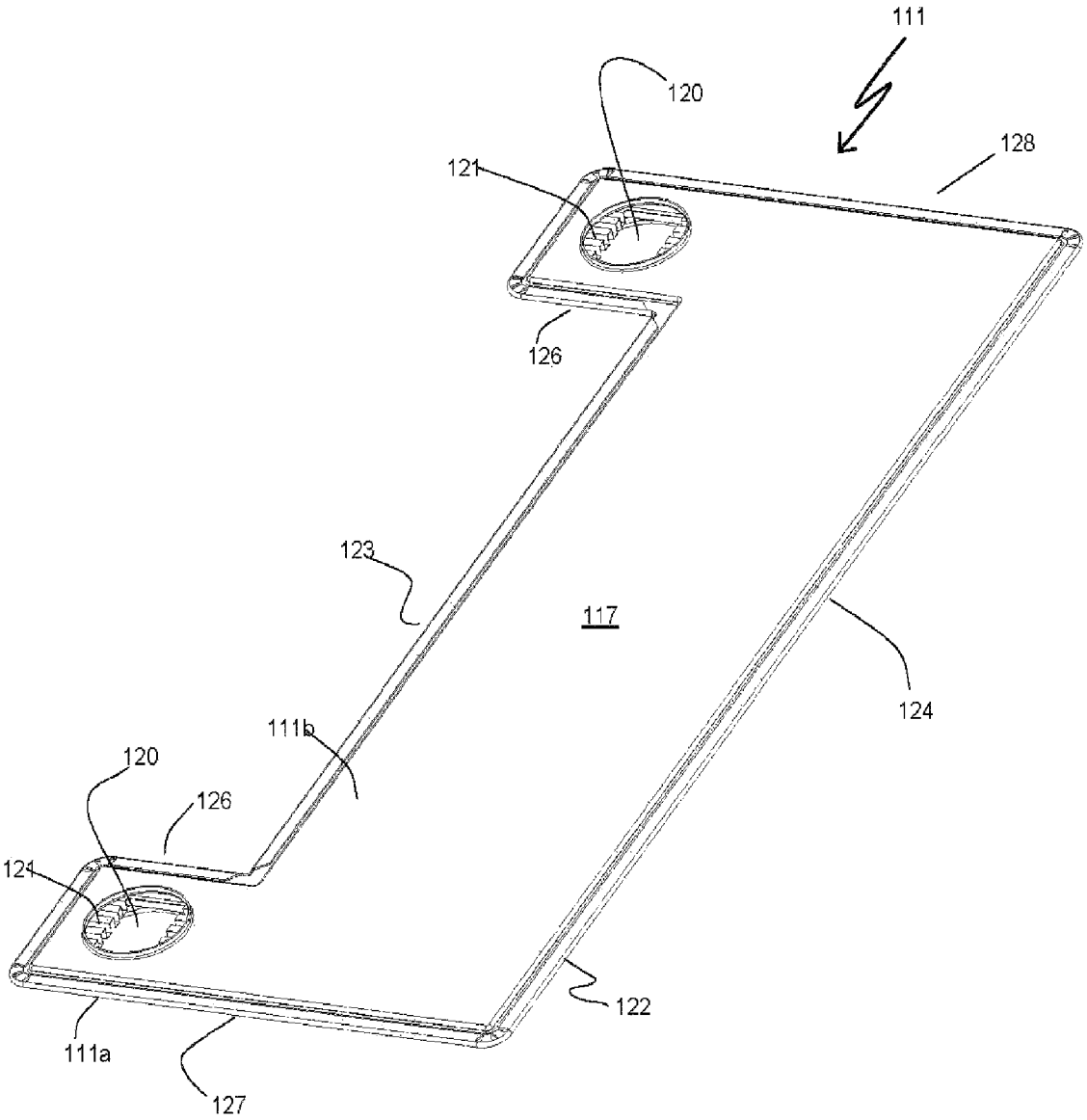
FIG. 7 is a perspective view of a plate assembly for use in the heat exchanger of FIG. 2.

An example of a single plate assembly 111 as used in the exemplary heat exchanger 101 is depicted in FIG. 7. As shown therein, the plate assembly 111 is of a two-piece construction, with a first plate half 111*a* joined to a second plate half 111*b*. Each of the plate halves 111*a, b* include a large planar wall section 117 spaced apart from the center of the plate assembly 111, so that a flow conduit for the working fluid is provided between the opposing wall sections 117 of a plate assembly 111. A crimped joint 122 is provided along the periphery of the plate assembly 111 to join the plate halves 111*a, b* together. The crimped joint 122 can be seen in greater detail in FIG. 5.

While the crimped joint 122 is shown to be located at approximately the mid-plane of the plate assembly 111, it could alternatively be located so as to be essentially coplanar with one of the wall sections 117. Further, while the exemplary embodiment shows a two-piece assembly with a crimp joint, the plate assembly 111 can alternatively be constructed using more components. For example, the plate halves 111*a* and 111*b* can be replaced by flat plates, and a spacer frame could be provided between the flat plates to provide the flow conduit for the working fluid.

Apertures 120 are provided in the plate halves 111*a, b* in the regions of the manifolds 113 to provide for fluid communication between the manifolds 113 and the internal flow conduit between the wall sections 117. The apertures 120 are provided in extensions 126 that extend off of a longitudinal edge 123 of the plate assembly 111. In some alternative embodiments, one or both of the extensions 126 could instead extend off of the opposite longitudinal edge 124. Further, while the exemplary embodiment shows the extensions 126 arranged at the ends 127 and 128 of the plate assembly 111, it should be understood that they could be arranged at any location along the edge 123 or the edge 124. In some embodiments it may be preferable, for example, for at least one of the extensions 126 to be spaced a distance away from an end 127 or 128. Such an arrangement could provide, for example, for an alternative relative flow arrangement between the two fluids, such as a cross-flow arrangement or a combination of counter-flow and concurrent-flow.

An internal flow structure 121 can be arranged within the flow conduit for the working fluid, and can be used to direct the working fluid through the flow conduit between the apertures 120. The internal flow structure can be embodied in any number of forms, including as a stamped flow sheet, a single corrugated fin structure, multiple corrugated fin structures, lanced and offset fin structures, etc. The internal flow structure 121 is optional, however, and in some embodiments it may be preferable to dispense with the internal flow structure 121 in order to provide a more open flow conduit for the working fluid. In such alternative embodiments it may be desirable to provide other features in the plate assembly 111 in order to maintain the spacing between the wall sections 117 and/or to provide structural support. As one example of such features, inwardly facing dimples can be provided on one or both of the plate halves 111 *a, b*.

Figure 3A:
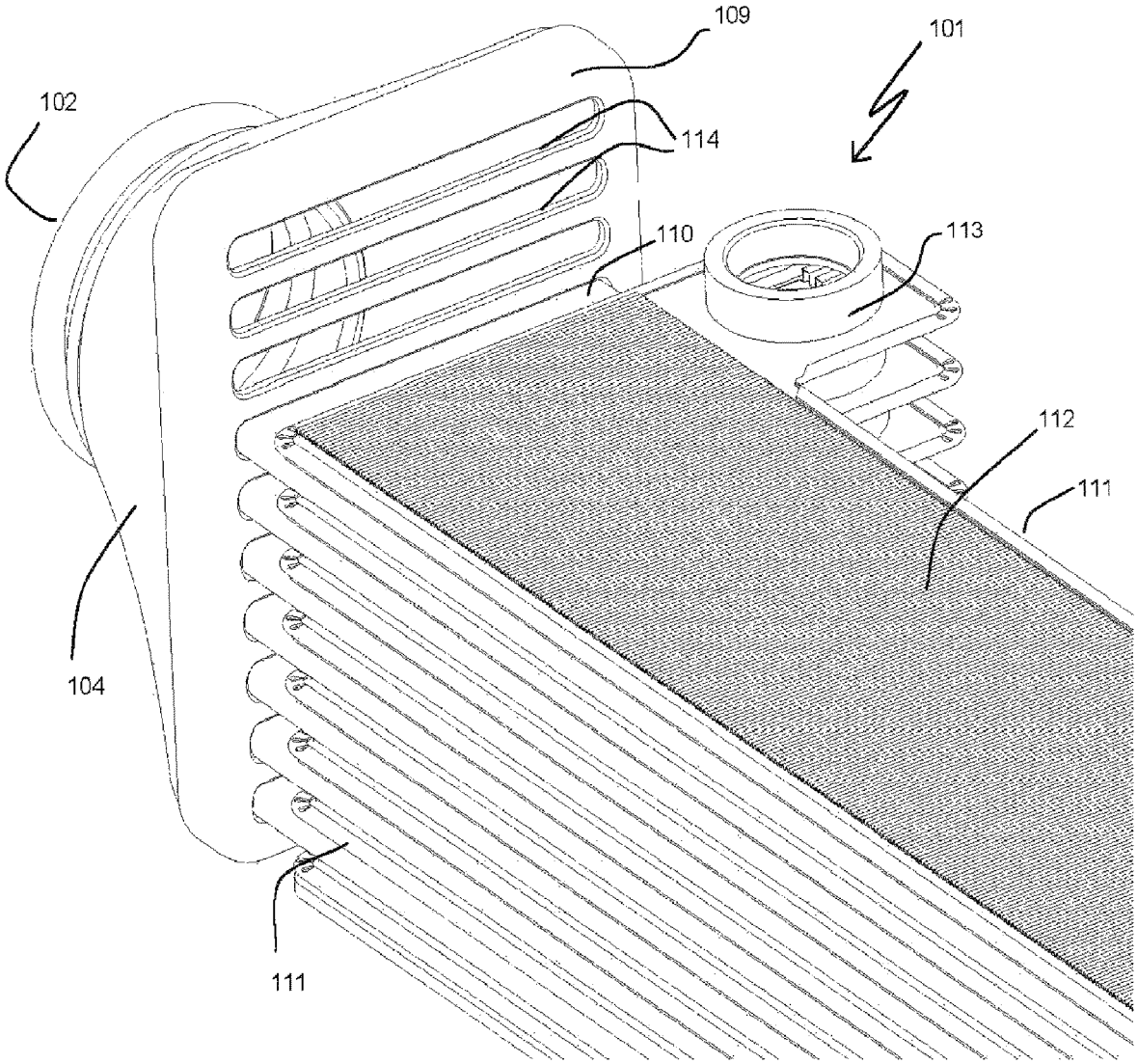
FIGS. 3A and 3B are partial perspective views of certain portions of the heat exchanger of FIG. 2.

Turning now to FIGS. 3A-5, the construction of the heat exchanger 101 will be explained in greater detail. FIGS. 3A and 3B both show the process fluid inlet end of the heat exchanger 101, with certain components removed for clarity in describing specific aspects of the heat exchanger 101.

Figure 3B:
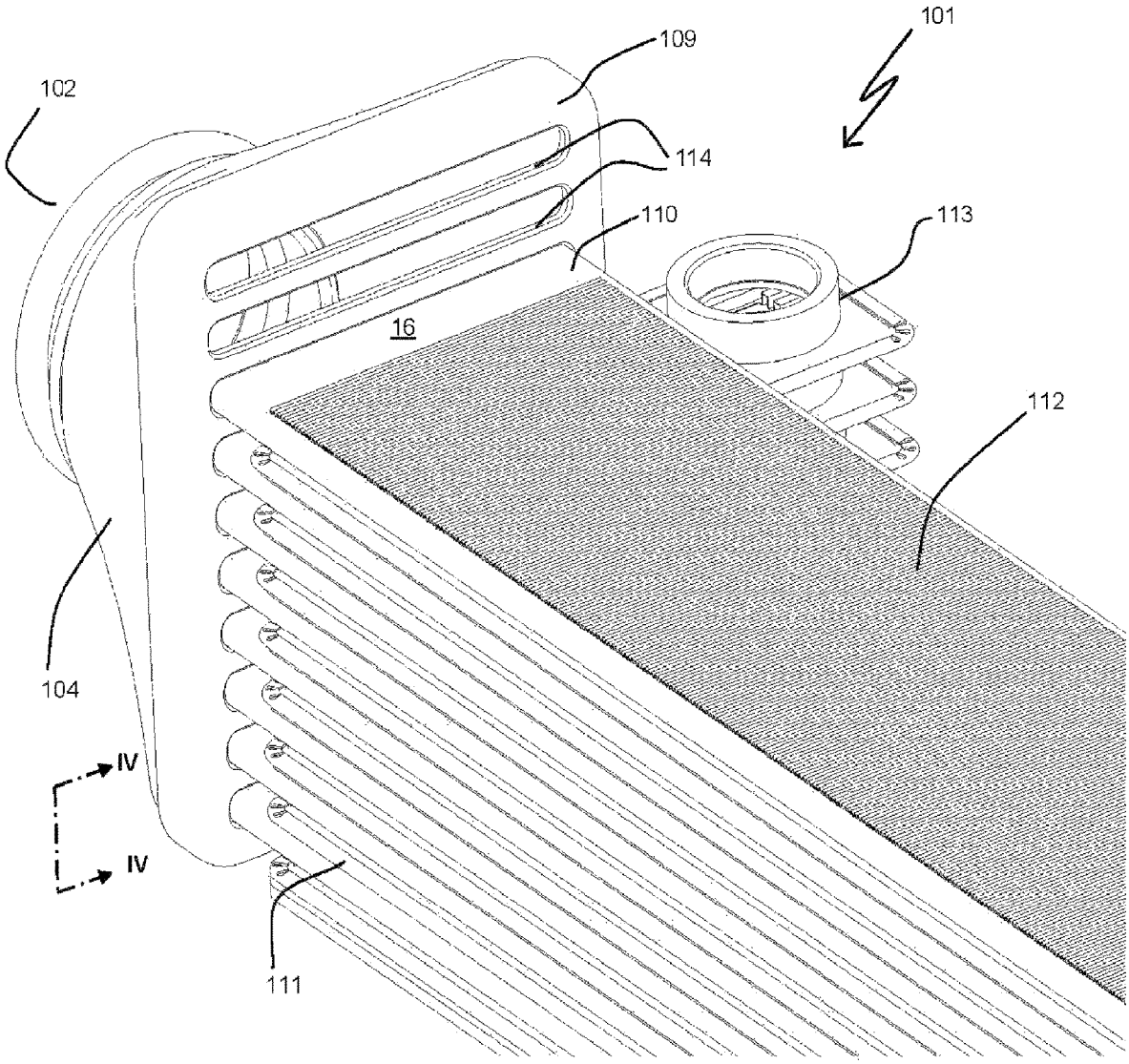

As shown in FIGS. 3A and 3B, the header 109 is provided with a plurality of tube slots 114, each sized and arranged to receive an end of a tube 110 so as to fluidly connect the flow conduit arranged within the tube 110 to the manifold 104. The plate assemblies 111 are interleaved with the tubes 110, as previously discussed. In addition, a structure 112 is provided between adjacent ones of the plate assemblies 111 and tubes 110. The structures 112 are provided as corrugated metal sheets, with the corrugations extending in a direction that is transverse to the flow direction of the process fluid through the heat exchanger 101.

Figure 4:
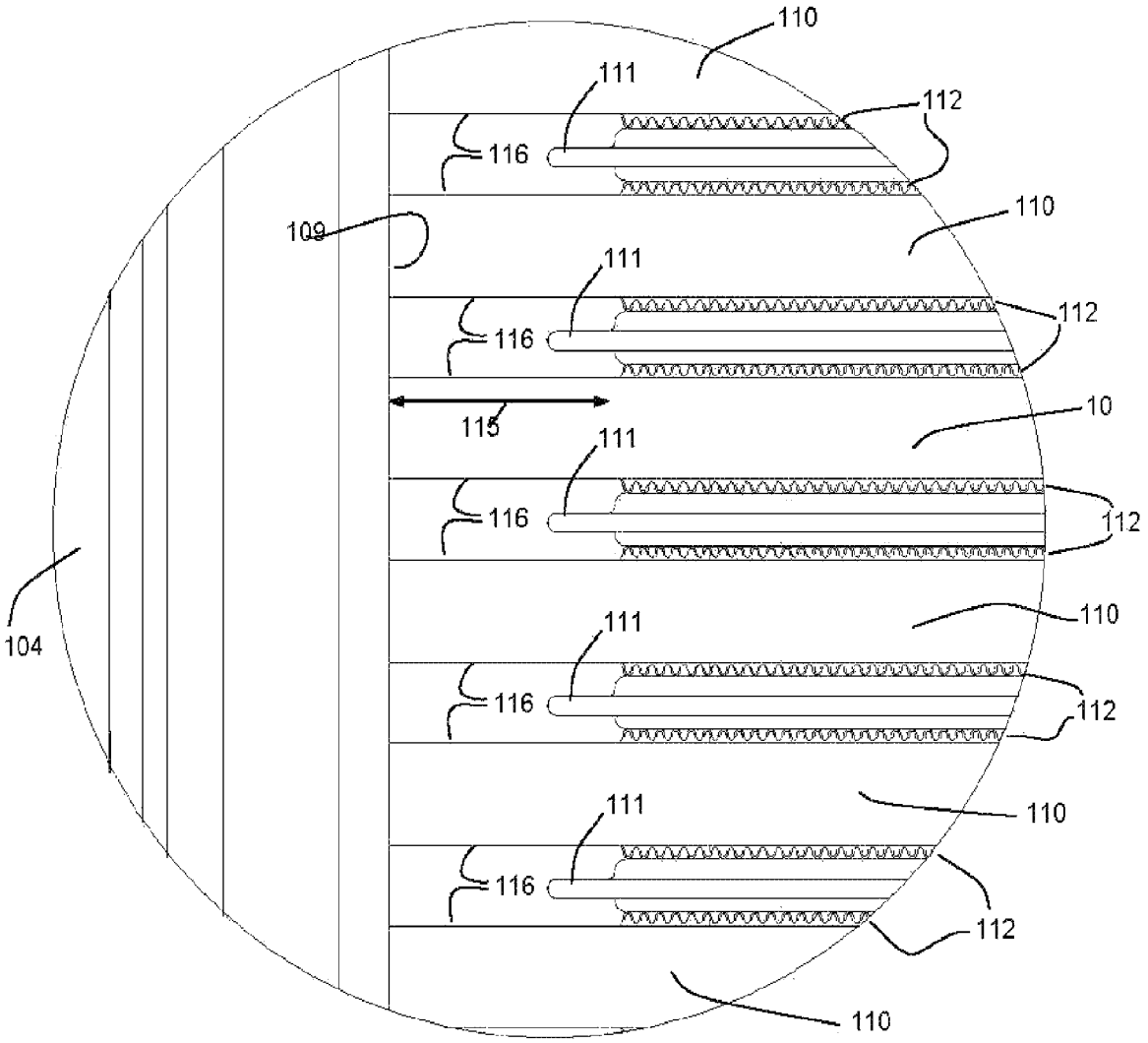
FIG. 4 is a detail view of a region of the heat exchanger of FIG. 3B, as viewed in the direction indicated by the arrows IV-IV.
Figure 5:
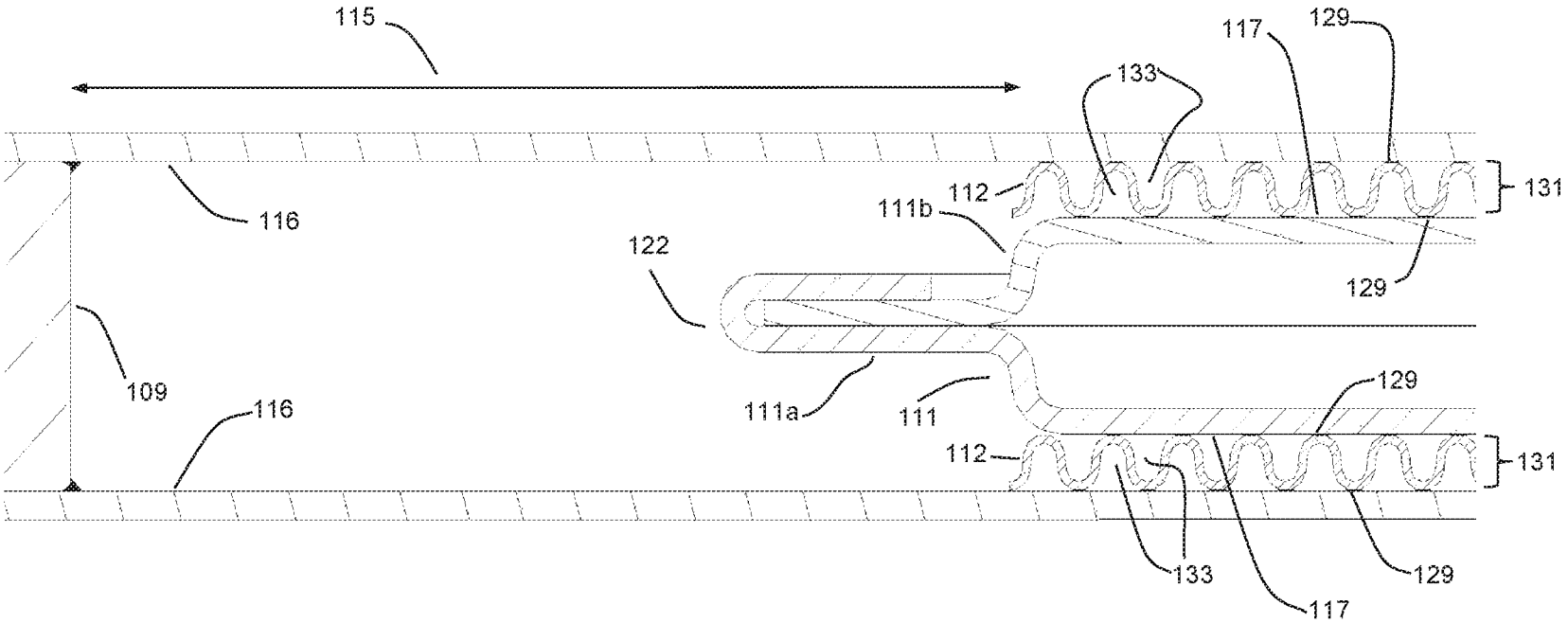
FIG. 5 is a partial cross-section view of a repeating portion of the heat exchanger of FIG. 2.

The structures 112 (as best seen in FIGS. 4 and 5) are placed within gaps 131 between the flat walls 116 of the tubes 110 and the adjacent flat wall sections 117 of the plate assemblies 111. The corrugations of the structure 112 define troughs and crests 129, which are alternatingly in contact with a wall 117 and a wall 116. Together, the plurality of tubes 110, plate assemblies 111, and structures 112 define a stack 130. The components of the stack 130 are preferably joined together into a monolithic assembly by metallurgically joining the crests and troughs 129 of the structures 112 to the adjacent walls 116, 117. Such metallurgical joining can be efficaciously accomplished by furnace brazing the components together. In some especially preferable embodiments, other components of the heat exchanger 101 can be simultaneously joined in the same process. For example, the ends of the tubes 110 can be sealingly joined to the headers 109; the plate halves 111*a* and 111*b* and the optional internal flow structure 121 can be joined; the inserts 119 can be joined to the tubes 110; and/or the manifolds 113 can be joined to the plate assemblies 111.

During operation of the heat exchanger 101, the process fluid containing waste heat travels through the flow conduits provided by tubes 110 while simultaneously the Rankine cycle working fluid 21 travels through the flow conduits provided by the plate assemblies 111. Waste heat is convectively transferred from the process fluid to the walls 116 of the tubes 110. This waste heat is then transferred via conduction from the walls 116 to the walls 117 of the plate assemblies 111, and is convectively transferred from the walls 117 to the working fluid.

Side plates 108 can be part of the metallurgically joined stack 130, and are preferably joined to the outermost ones of either the tubes 110 or the plate assemblies 111. Optionally, the side plates 108 can be joined to the outermost tubes 110 or plate assemblies 111 with a structure 112 arranged therebetween. Stresses due to differing thermal expansion rates between a side plate 108 and the joined tube 110 or plate assembly 111 can be avoided by the inclusion of compliant or self-breaking features 125 in the side plates 108.

Preferably, the structures 112 are constructed of a material with relatively high thermal conductivity. In some embodiments the structures 112 are formed from a ferritic or austenitic steel in order to strike a balance between, on the one hand, the desire for high thermal conductivity, and on the other hand, the need for a material capable of surviving the high operational temperatures of the heat exchanger 101. In other embodiments a more thermally conductive material such as copper or aluminum can be used. In any event, the thermal conductivity of the material, coupled with the high spacing density of the corrugations, allows the structures 112 to serve as thermally conductive bridges between the tubes 110 conveying the process fluid and the plate assemblies 111 conveying the working fluid, so that heat can be transferred between the fluids.

With the above described construction of the heat exchanger 101, the possibility of a cross-leak between the process and working fluids is greatly minimized. Even if a leak were to occur, either in a wall of one of the tubes 110 or a wall of one of the plate assemblies 111, the fluid would leak into the gap 131 and not into the other fluid. In preferable embodiments, the process and working fluids would both be operating at a pressure that is greater than the pressure in the gap 131 (which is usually, but not necessarily always, atmospheric pressure). In such embodiments, a cross-leak between the process and working fluids is highly unlikely even if a leak were to develop in both one of the tubes 110 and one of the plate assemblies 111, as both fluids would leak to the lower pressure found in the gap 131.

The structure 112 as described above and in the appended figures provides additional benefits in providing separation between the fluids in the case of a leak in both one of the tubes 110 and one of the plate assemblies 111. As best seen in FIG. 5, the crests and troughs 129, bonded in alternating succession to a wall 116 of a tube 110 and a wall section 117 of a plate assembly 111, provide a plurality of parallel arranged channels 133 extending in a width direction of the heat exchanger 101 (i.e. the direction wherein the short walls 118 of the tubes 110 are spaced apart). Each of the channels 133 is bounded on one side by one, but not both, of a wall 116 and a wall section 117, and on the other side by a crest or trough 129. Thus, even if a failure were to occur in both a wall section 117 of a tube assembly 111 and in an adjacent wall 116 of a tube 110, the wall section 117 and the wall 116 being separated by the gap 131, each of the process and working fluids would leak into separate ones of the channels 133. As a result, the hypothetical leak path between the two fluids would need to extend through each of those two channels 133, rather than through the relatively small gap 131.

The foregoing notwithstanding, the structures 112 can be embodied in other ways without deviating from the present invention. For example, the structures 112 might alternatively comprise a machined plate of a thickness approximately equal to the gap 131, the plate having channels provided therein. As another example, the structures 112 might alternatively comprise a formed wire placed within the gaps 131. As yet another example, the structures 112 might comprise porous sintered metal, metal mesh, etc.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A power generation system having a combustion engine with a Rankine bottoming cycle, comprising:

a first flow path for a process fluid of the combustion engine, the first flow path extending between a fluid source and an intake air stream of the combustion engine;

a second flow path for a working fluid of the Rankine bottoming cycle, the second flow path extending between a pump and an expander; and a heat exchanger arranged along both the first and the second flow paths to transfer waste heat from the process fluid to the working fluid, the heat exchanger comprising:

at least one first flow conduit to convey the process fluid through the heat exchanger, the at least one first flow conduit being bounded by a first wall section;

at least one second flow conduit to convey the working fluid through the heat exchanger, the at least one second flow conduit being bounded by a second wall section spaced apart from the first wall section to define a gap therebetween; and a thermally conductive structure arranged within the gap and joined to the first and second wall sections to transfer heat therebetween, the gap being fluidly isolated from both the process fluid and the working fluid, wherein the gap contains air that is in direct fluid communication with ambient air surrounding the power generation system.

2. The power generation system of claim 1, wherein the process fluid of the combustion engine comprises a recirculated exhaust gas.

3. The power generation system of claim 1, wherein the process fluid of the combustion engine comprises boosted charge air.

4. The power generation system of claim 1, wherein the working fluid of the Rankine cycle comprises a combustible fluid.

5. The power generation system of claim 1, wherein the working fluid of the Rankine cycle comprises a hydrofluorocarbon.

6. The power generation system of claim 1, wherein the process fluid along the first flow path is at a first pressure, the working fluid along the second flow path is at a second pressure, the gap between the first and second wall sections is at a third pressure, and both the first and the second pressures are greater than the third pressure.

7. A power generation system having a combustion engine with a Rankine bottoming cycle, comprising:

a first flow path for a process fluid of the combustion engine, the first flow path extending between a fluid source and an intake air stream of the combustion engine;

a second flow path for a working fluid of the Rankine bottoming cycle, the second flow path extending between a pump and an expander; and a heat exchanger arranged along both the first and the second flow paths to transfer waste heat from the process fluid to the working fluid, the heat exchanger comprising:

at least one first flow conduit to convey the process fluid through the heat exchanger, the at least one first flow conduit being bounded by a first wall section;

at least one second flow conduit to convey the working fluid through the heat exchanger, the at least one second flow conduit being bounded by a second wall section spaced apart from the first wall section to define a gap therebetween;

a thermally conductive structure arranged within the gap and joined to the first and second wall sections to transfer heat therebetween, the gap being fluidly isolated from both the process fluid and the working fluid; and a plurality of channels arranged within the gap and defined by the thermally conductive structure and the first and second wall sections.

8. The power generation system of claim 7, wherein each one of the plurality of channels is bounded by exactly one of the first and second wall sections.

9. The power generation system of claim 7, wherein the thermally conductive structure comprises a corrugated sheet.

* * * * *